US005639037A

United States Patent [19]

Marangone et al.

[11] Patent Number: 5,639,037

[45] Date of Patent: Jun. 17, 1997

[54] METHOD AND APPARATUS FOR DISTRIBUTING WOUND YARN ON A BOBBIN DRIVEN BY A GROOVED ROLLER

[75] Inventors: Nereo Marangone; Luciano Bertoli, both of Pordenone; Giorgio Colomberotto, Sacile, all of Italy

[73] Assignee: Savio Macchine Tessili S.r.l., Pordenone, Italy

[21] Appl. No.: 263,430

[22] Filed: Jun. 21, 1994

[30] Foreign Application Priority Data

Jun. 25, 1993 [IT] Italy ..... MI93A1374
Jun. 25, 1993 [IT] Italy ..... MI93A1375

[51] Int. Cl.[6] ..... B65N 54/38

[52] U.S. Cl. ..... 242/18.1; 242/18 DD; 242/43 R

[58] Field of Search ..... 242/18.1, 43 R, 242/18 DD

[56] References Cited

U.S. PATENT DOCUMENTS

| | | | |
|---|---|---|---|
| 1,915,241 | 6/1933 | Reece | 242/18.1 |
| 2,524,121 | 10/1950 | Crouzet | 242/18.1 |
| 4,696,435 | 9/1987 | Hermanns . | |
| 5,002,234 | 3/1991 | Colli et al. . | |
| 5,056,724 | 10/1991 | Prodi et al. . | |

FOREIGN PATENT DOCUMENTS

| | | | |
|---|---|---|---|
| 0 260 682 | 3/1988 | European Pat. Off. . | |
| 0 272 721 | 6/1988 | European Pat. Off. . | |
| 0 375 043 | 6/1990 | European Pat. Off. . | |
| 1131754 | 2/1957 | France | 242/18.1 |
| 24 03 341 | 7/1975 | Germany . | |
| 1664708 | 7/1991 | U.S.S.R. | 242/18 DD |
| 727027 | 3/1955 | United Kingdom | 242/18.1 |
| 872608 | 7/1961 | United Kingdom . | |
| 2127443 | 4/1984 | United Kingdom . | |

*Primary Examiner*—William Stryjewski
*Attorney, Agent, or Firm*—Oblon, Spivak, McClelland, Maier & Neustadt, P.C.

[57] ABSTRACT

A method and apparatus serves to wind yarn on a forming bobbin driven by a grooved drive roller in a collection station, in such a manner as to prevent ribbing during the continuous superposing of the various layers of winding, hence rendering the subsequent technical operations to be undergone by the bobbin yarn both possible and simple. The apparatus includes a control unit having a keyboard, a mini-computer and a motive source which angularly positions the bobbin carrier arm such that the collection station operates in regions not in proximity with regions undergoing a ribbing effect.

5 Claims, 8 Drawing Sheets

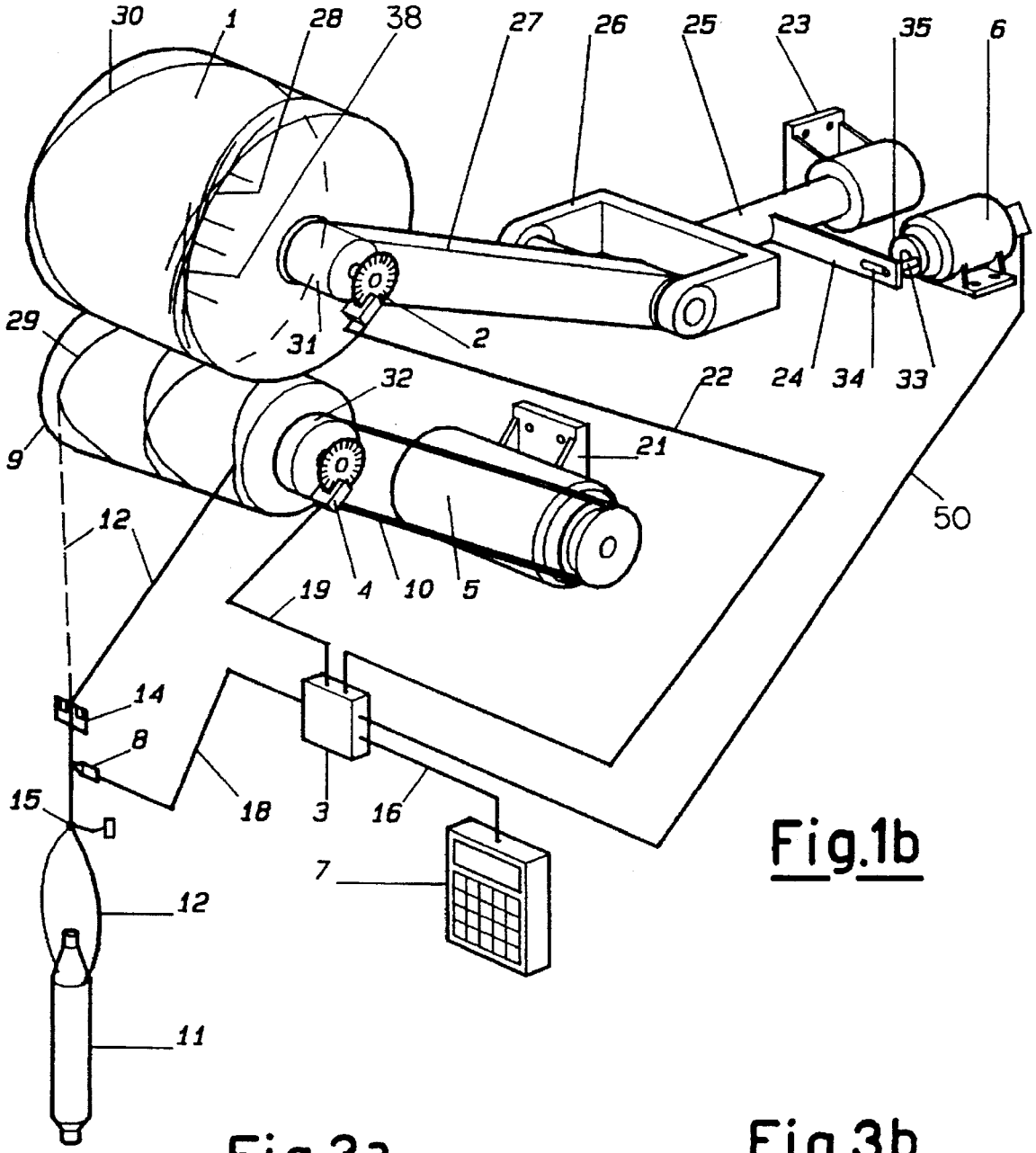
Fig.1b
Fig.3a
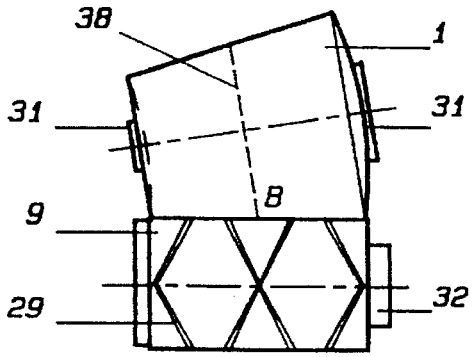
Fig.3b
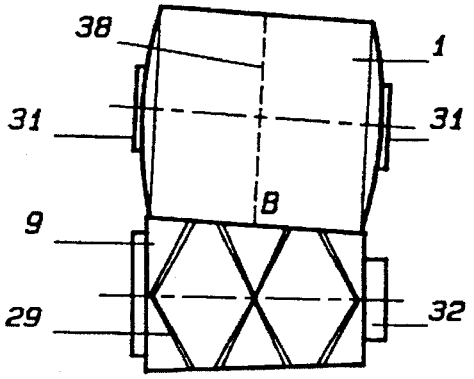

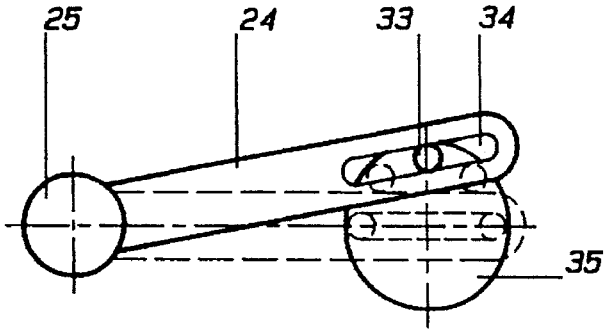
Fig.8
Fig.9a
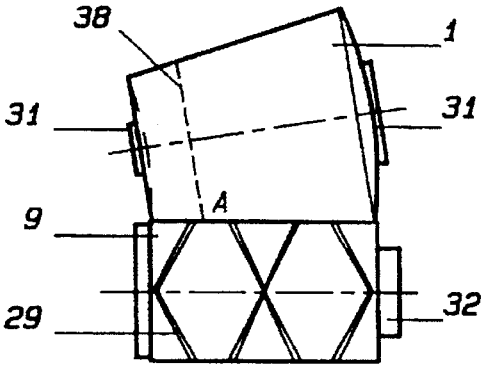
Fig.9b
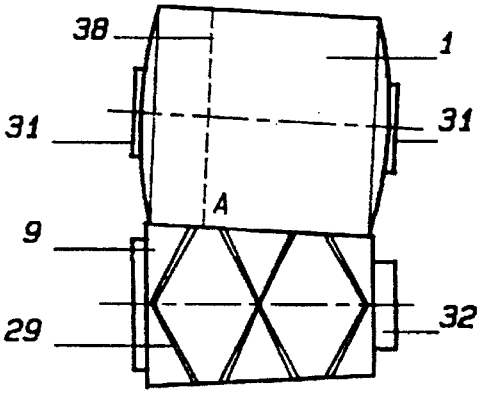
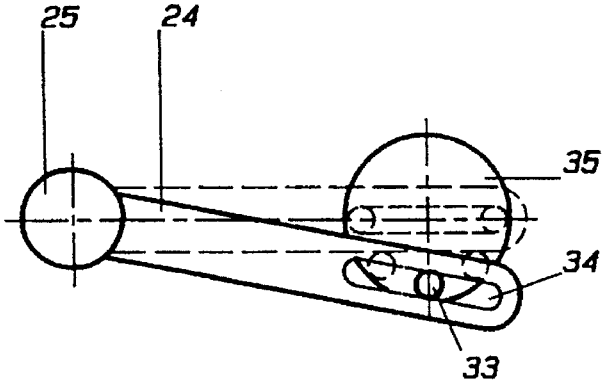
Fig.14
Fig.15a
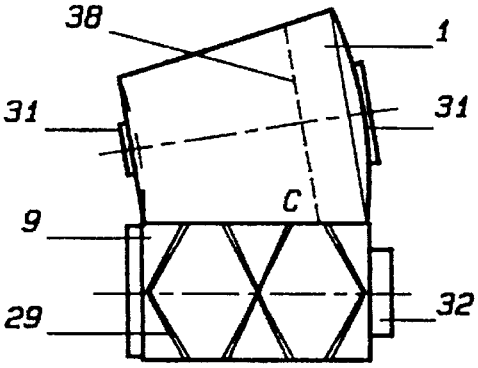
Fig.15b
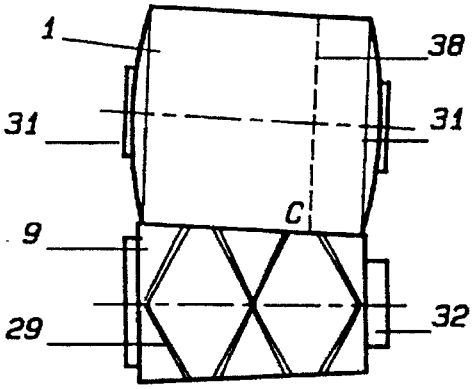

METHOD AND APPARATUS FOR DISTRIBUTING WOUND YARN ON A BOBBIN DRIVEN BY A GROOVED ROLLER

BACKGROUND OF THE INVENTION

1. Field of the Invention

This invention relates to a method and apparatus for distributing wound yarn on a forming bobbin driven by a grooved drive roller in a collection station for textile yarns, a bobbin and a roller having shapes which are different from each other. In other words, this invention relates to a method and apparatus for distributing wound yarn on a conical bobbin driven by a grooved cylindrical roller, or for distributing wound yarn on a cylindrical bobbin driven by a grooved cone.

More specifically, said apparatus comprises a control unit based on a mini-computer into which the operative winding data are fed for processing and comparing with the data arriving from transducer probes or similar means, to provide at the minicomputer output a number of command signals for activating and controlling the motive source which angularly positions the bobbin carrier arm so that the collection station operates in regions not subject to the ribbing effect.

In the ensuing description and claims, the term "yarn" or "filament" indicates any type of filiform material, and the term "bobbin" indicates any package formed from yarn wound in substantially helical turns.

2. Discussion of the Background

In the state of the art a winding operation is used to form the yarn into a package suitable for subsequent processing. Winding by dragging is known, in which the bobbin is driven by friction by a grooved roller driven by the drive shaft. According to the above alternative cases, this roller can be a cylindrical roller with the produced bobbin being conical, or this roller can be a conical or frusto-conical element with the produced bobbin being cylindrical.

Within the helically arranged grooves the yarn is compelled to follow their movement, so that the rotation of the roller produces a corresponding rectilinear transnational movement of the yarn.

With reference to this field of the art, the problems strictly related to the principle of distribution of the yarn on the forming bobbin are of considerable importance. The winding units or stations arranged to produce bobbins of wound yarn almost always form deposits of turns concentrated at certain points, to form ribbing. This yarn distribution defect arises during bobbin winding when a wound turn is superposed on and is parallel to the previous turns.

This phenomenon occurs if the bobbin circumference is equal to the length of the winding turn, or to a multiple or a sub-multiple thereof. This type of winding in the form of substantially superposed turns results in hard bands within the bobbin. Said ribbing is known hereinafter as ribbing, taping or "mirror effects", these terms being used interchangeably.

These ribbing defects arise during winding if the ratio of the number of revolutions of the bobbin to the number of double beats of the traverser device or the number of complete to-and-fro movements of the yarn per unit of time is a whole number.

Under these conditions, after a complete to-and-fro movement of the yarn the starting point of the turns forming the new layer coincides with that of the previous layer.

This results in hardened superposed yarn layers forming ribbing, i.e. taping of maximum density, which compromises correct subsequent unwinding of the yarn or compromises the uniformity of liquid passage through bobbins during dyeing, resulting in layers not uniformly dyed and thus, leading to periodic variations in yarn color. To avoid these drawbacks a fractional ratio must be chosen so that the turns are advantageously displaced slightly from the corresponding underlying turn. It will be assumed that the bobbin rotational speed varies with time by virtue of maintaining its peripheral speed constant as its diameter grows, whereas the grooved drive roller, against which the bobbin rests, rotates at a constant speed with the result that the complete to-and-fro movements of the yarn remain constant with time.

Its ratio to the bobbin angular speed Wr varies continuously from a minimum (bobbin commencement) to a maximum (bobbin full), passing through intermediate whole-number values or exact fractional values. Said ratio is defined hereinafter as "winding ratio K" of the forming bobbin.

For each of said whole-number values or exact fractional values ribbing forms, i.e. the superposing of several yarn turns to give rise to the mirror effect. The aim of any winding system is therefore to deposit layers which do not generate problems during the subsequent use of the bobbin. For example the density of each layer must not differ from that of the preceding layer by more than a certain amount. Known methods and devices operate in various ways.

The most widely used methods involve discontinuity in the rotation of the bobbin under formation by raising it periodically from its driving contact with the underlying grooved cylindrical roller. The bobbin, which continues to rotate, gradually slows down until it is again brought into contact with the drive roller. It also forms part of the known art to periodically interrupt the rotation of the roller by cutting power to its electric drive motor, or by disengaging the grooved roller from the motor by a clutch or the like.

In recent years it has been proposed to periodically vary the speed of the motor which rotates the grooved roller. This method has considerable operational drawbacks because, as is well known to the expert of the art, its effect varies with varying the diameter of the bobbin under formation. The present applicant is the proprietor of the patent IT 1198214 relating to variation in the transmission of motion between the grooved drive roller and the bobbin for the purpose of varying their point of driving contact by virtue of the taper of the bobbin and/or of its deformability, hence varying the diameter on which it is driven and consequently their transmission ratio.

A different method proposed to prevent wound yarn turns from becoming superposed is described in DE 3521152.0 which describes and claims a method and device which effect a controlled and progressive variation in the rotational speed of the grooved drive element with simultaneous controlled braking of the bobbin, so that its peripheral speed remains constant within tolerance limits.

SUMMARY OF THE INVENTION

These and further expedients proposed by the known art to satisfy all the requirements for properly distributing the yarn on the bobbin under formation have always resulted in often precarious operation, giving rise to more or less accentuated ribbing and winding which is not always reproducible from a quality aspect. An object of the present invention is to obviate the aforementioned drawbacks by providing a method and automatic apparatus producing a faultless result which is reliably reproducible in terms of the quality of the winding, embodied essentially by the need to achieve yarn distribution which is uniform both widthwise and depthwise in the formation of bobbins of any size. A further object of the invention is to form bobbins using continuous control of the peripheral distance between each turn and the next which is able to recognize in advance that ribbing is about to take place and which operates in the sense of varying the transmission ratio in a controlled manner to the extent strictly necessary to maintain a predetermined distance between turns, until conditions arise which indicate that the preceding conditions of potential ribbing no longer exist.

Said control acts by eliminating ribbing of the 1st, 2nd, 3rd, 4th . . . order, and can also be extended to ribbing of higher order, even though this is not necessary in that the negative effects induced by ribbing of an order exceeding the 4th are insignificant in the practical use of the bobbin.

A further object of the invention is to wind the yarn in such a manner as to produce well bound bobbins of homogeneous compactness or softness in each point or region of the bobbin under formation, such as to make it perfectly permeable to dyeing liquids, which are able to lap each side of the wound yarn.

These and further objects are all attained by the method of the present invention which enables the deposition distance between two yarn turns successively deposited on the bobbin under formation to be determined moment by moment; and which on the basis of previously recorded successive variations in the distance between two consecutive turns also determines when said distance falls below a predetermined minimum value, and when said distance again rises above said predetermined minimum value; and further which, before the distance between two consecutive yarn turns falls below the predetermined minimum value, activates a motive source which by means of a lever linkage progressively inclines the bobbin to vary its transmission ratio with the grooved drive element, in order to maintain the distance between consecutive turns about a value slightly greater than the predetermined minimum value and to progressively increase the bobbin inclination each time the distance between said consecutive turns tends to fall, at least until the deposition of consecutive turns at a distance apart less than the predetermined minimum value ceases; and which also enables the initial conditions to be quickly restored by operating the motive source to incline the bobbin in the opposite direction to annul the previously induced inclination and cause a change in the transmission ratio, which at a certain moment assumes a value corresponding to deposition of turns at a distance apart less than the predetermined minimum distance and even zero distance apart, but with a rapidity such as to cause only an insignificant quantity of turns to be deposited very close to or to be superposed on each other, and which does not damage the quality of the bobbin under formation.

The apparatus used for the implementation of the method of the present invention comprises a control unit based on a mini-computer into which the values relating to the winding parameters, those ribbing orders considered damaging to the quality of the winding underway, and the predetermined minimum distance between two consecutive yarn turns in one complete to-and-fro deposition of the yarn on the surface of the forming bobbin are fed via a keyboard, said values being processed in the computing center of the mini-computer for the computerized formation of a group of curves each having a constant "winding ratio" of a whole number or an exact fraction considered dangerous, the mini-computer then receiving electrical pulses generated at each revolution, or submultiple thereof, of the grooved drive roller and bobbin carrier mandrel by known transducer probes applied to them, to unambiguously provide knowledge of the rotational values of said members at each moment, these latter values being compared with said operational winding parameters within the electronic comparator of the mini-computer, in order to generate a number of command signals in continuous succession to activate and control the motive source which angularly positions the bobbin carrier arm such that the collection station operates in regions not in proximity to the ribbing effect.

According to one embodiment, the apparatus of the present invention is provided in each yarn winding station. The invention is described in detail hereinafter with reference to the constructional example shown schematically in the figures of the accompanying drawings wherein the figures with index (a) are referred to a winding machine with a grooved cylindrical drive roller, that produces conical bobbins, whereas the figures with index (b) are referred to a winding machine with a grooved cone drive element, that produces cylindrical bobbins and wherein, the figures without index are common to the above alternative cases.

The term "conical" is intended to indicate a frusto-conical element having an inclination which is substantially small but it is sufficient to allow the rotational speed of the driven bobbin to be varied so as to vary the winding of wound yarn turns when the position of the line of contact between the bobbin and the drive element changes.

BRIEF DESCRIPTION OF THE DRAWINGS

The figures illustrate the characteristics of the invention in summary form, the accompanying drawings and the description thereof relating to only a preferred embodiment to make its method of implementation more understandable, all constructional modifications to the accompanying drawings being included within its scope of protection wherein:

FIGS. 1*a* and 1*b* are perspective schematic views of a winding station with a bobbin under formation, the figures also showing schematically the lever linkage which inclines the bobbin and the functional electrical connections from the transducers sensing the angular rotation of the grooved drive roller and bobbin carrier mandrel to the control unit and to the control and activation means for a motive source which sets the correct driving diameter to achieve wound yarn distribution free from damaging ribbing effects;

FIGS. 3*a* and 3*b* show schematically the driving contact line between the bobbin and grooved drive roller when in a central position B corresponding to the position of the lever linkage of FIG. 2;

FIG. 8 schematically shows that lever maximum angular inclination position under which the bobbin is orientated such that it is dragged on a line A close to its left end;

FIG. 9*a* shows schematically the line on which the bobbin is dragged by the grooved cylindrical roller in a position close to that end of the bobbin corresponding to its minor diameter;

FIG. 9b shows schematically the line on which the bobbin is dragged by the grooved drive cone in a position close to the major diameter of the cone wherein the relative positions shown in FIGS. 9a and 9b correspond respectively to a conical bobbin dragged by the grooved cylindrical roller in a position close to that end of the bobbin corresponding to its minor diameter, and to a cylindrical bobbin dragged by the grooved cone in a position close to the major diameter of the cone.

FIG. 14 schematically shows that lever maximum angular inclination position under which the bobbin is orientated such that it is dragged on a line C close to its right end;

FIG. 15a shows schematically the line C on which the bobbin is dragged by the grooved cylindrical roller in a position close to that end of the bobbin corresponding to its major diameter;

FIG. 15b shows schematically the line C on which the bobbin is dragged by the grooved drive cone in a position close to the minor diameter of the cone wherein the relative positions shown in FIGS. 15a and 15b correspond respectively to a conical bobbin dragged by the grooved cylindrical roller in a position close to that end of the bobbin corresponding to its major diameter, and to a cylindrical bobbin dragged by the grooved cone in a position close to the minor diameter of the cone.

FIG. 20 is an enlarged view of a region of the diagram of

FIG. 21, namely that region embracing a ribbing line considered dangerous for the winding underway;

DESCRIPTION OF THE PREFERRED EMBODIMENTS

Figure 1A:
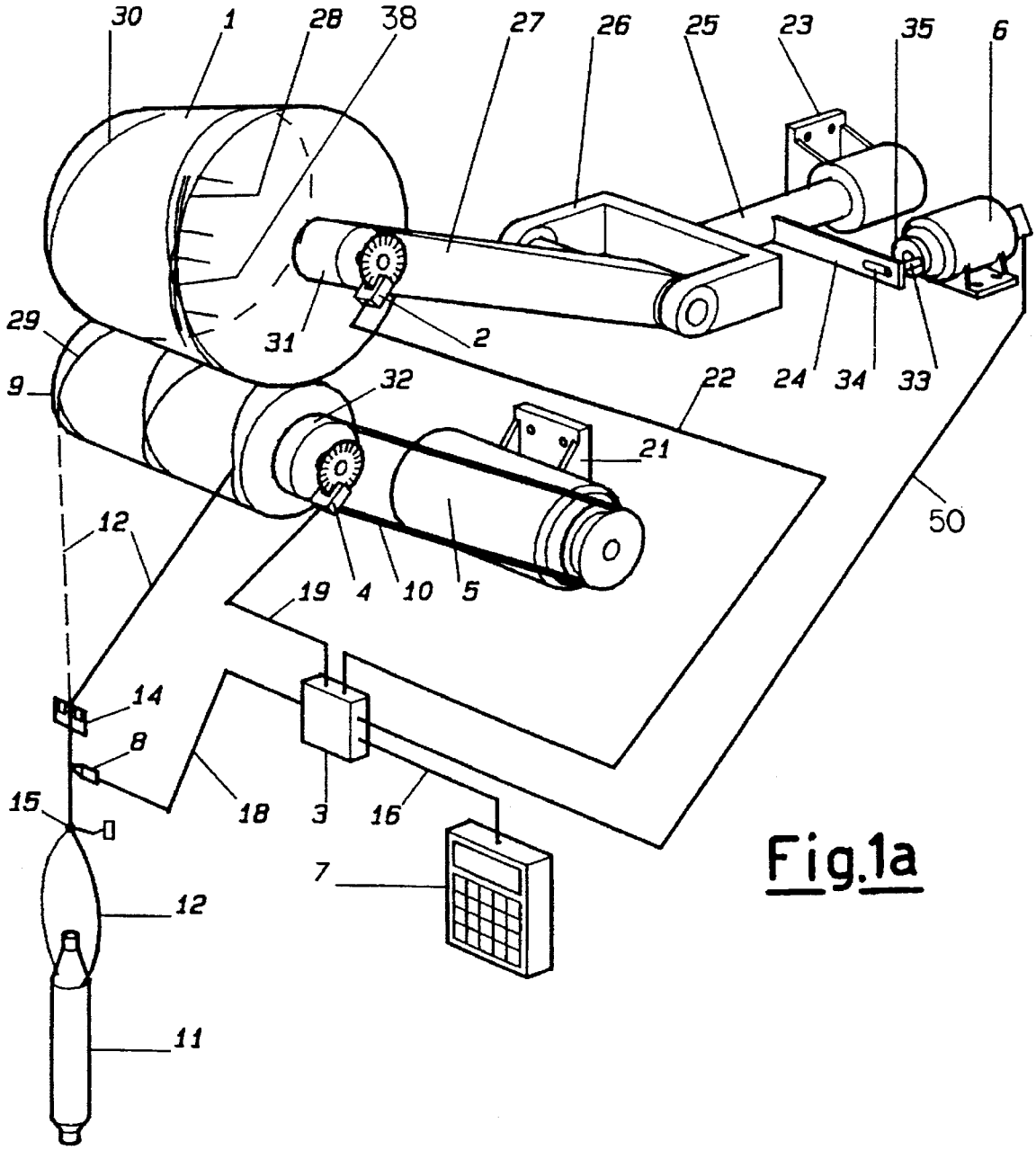

In the figures identical parts or parts of identical function carry identical references. Again in the figures, for overall clarity those parts not concerned with the understanding of the invention are omitted or are shown generically because they are of known type.

In said accompanying figures, reference number 9 is the grooved drive element (respectively cylindrical or conical) the surface of which comprises helically arranged cavities 29, in said cavities 29 the yarn 12 unwound from the feed package 11 being compelled to undergo reciprocating rectilinear translation movement, so that it becomes collected in turns 30 on the bobbin 1 (respectively conical or cylindrical) under formation, until the latter reaches the required package diameter; 27 is the bobbin carrier arm which supports the package 1 of wound yarn 12 as its diameter increases; 26 is a fork-shaped element which rocks angularly about the pin 25, which is connected to a support 23, the latter being rigidly joined to the structure of the machine (not shown); 10 is the belt, preferably toothed to provide positive transmission between the device source 5, with support 21, and the shaft 32 on which the grooved drive roller 9 is rigidly keyed; 24 is a single lever which at one end is rigid with the pin 25 and at its other end comprises an elongate slot 34 operationally engaging the pin 33.

Said pin 33 is subjected to angular movements by the frontal disc 35, the latter being driven angularly by the device source 6, which is preferably in the form of a known stepping motor; 4 is the sensor disc which measures moment by moment the rotational speed of the grooved drive element 9 during the entire formation cycle of the bobbin 1; 14 is the known yarn clearer provided for controlling the yarn during cross-winding; 2 is the sensor disc which measures moment by moment the rotational speed of the mandrel 31 which clamps and locks the tube representing the support for the yarn 12 wound in the form of crossed helical turns 30; 8 is a sensor the purpose of which is to sense the presence or absence of the fed yarn 12, which on unwinding is guided by a yarn guide ring 15; 3 is the control unit, based on a mini-computer or electronic card, for storing the operator instructions introduced via the keyboard 7. Said control unit 3 is able to convert said instructions arriving via the cable 16 into a program suitable for execution by its calculation and processing center in order to provide, moment by moment, the signals required during the entire winding process.

The control unit 3 is substantially in the form of a microprocessor using as input the information obtained by the sensor discs 4 and 2 via the cables 19 and 22 and from the sensor 8 via the cable 18, and providing electrical pulses which are transmitted along the cable 50 to cause precise angular movements of the disc 35 via the motive source 6; 28 is the circumferential arc between two points of inversion of the turns of yarn 12 deposited along the side of the bobbin 1 on termination of two successive to-and-fro movements of the yarn 12 being wound; and 38 is the line or rather the sufficiently narrow band on which the bobbin 1 is dragged into rotation by the grooved drive roller 9.

K1, K2, K3, K4, K5 . . . are those lines of whole-number or exact fraction winding ratio which overall represent the orders of ribbing considered dangerous for the quality of the winding underway in the formation of the bobbin 1; "K" is the winding ratio defined herein as the ratio of the number of revolutions of the grooved drive roller "Wc" to the number of revolutions of the bobbin under formation "Wr" per unit of time.

It is immediately apparent that the constant "K" lines are of increasing value from the commencement of bobbin winding to the termination of winding on reaching the final bobbin diameter; 47 is the line of bobbin formation with constant winding angle, which is predetermined and pre-set from the commencement of the yarn collection process.

The following description of operation, with reference to the stated figures, relates in particular to that which is new and hence examines only the apparatus of the present invention, which governs and controls the means for distributing the yarn on the forming bobbin in such a manner that the winding layers are superposed without any ribbing effects, so producing yarn depositions of uniform compactness, any devices or means of the known art associated therewith within the collection unit not being described.

The operator firstly switches on the apparatus by which the bobbin will be guided to undergo formation with continuous crossed turns of yarn fed from the package 11. The various requests for the operative yarn winding parameters then appear either together or progressively on the window screen of the keyboard 7. The operator reads these requests and provides the following values:

- the reference speed for the collection of the yarn 1 and hence the rotational speed of the grooved drive element 9 which by virtue of its helically-arranged cavities provides a precise crossing or winding angle;
- the distance between consecutive wound yarn turns corresponding to complete to-and-fro movements of yarn collection, one following the other, said distance being predetermined and pre-set with a minimum acceptability limit.

These values are keyed into the control unit 3 by the operator via the keyboard 7, and are processed within its calculation center in accordance with a previously stored program. In addition to the operative parameters for the winding station, the whole group of lines of whole-number or exact fraction "K" values are determined and memorized, together with the width of the band zone straddling said ribbing lines, this width being determinable in value, and derivable from the minimum acceptable distance between two said consecutive turns.

After this initial setting, the service operator activates the entire winding station and commences the winding process. The motive source 5 rotates the grooved drive roller 9 up to its steady working speed, i.e. to the reference speed for collecting the yarn 12, which deposits on the tube with a constant crossing angle. The winding underway then follows the inclined line of FIG. 21, said line representing the line 47 of FIG. 20 in terms of the progressive winding points. The control unit 3 processes the input data from the sensor discs 2 and 4 in its microprocessor or microprocessor card using its internal program, to calculate moment by moment the winding ratio "K", which represents the ratio of the rotational speed "Wc" of the grooved drive roller 9 to the rotational speed "Wr" of the bobbin 1.

The winding ratio "K" indicates a simple transmission ratio, and the terms "winding" and "transmission' can be used interchangeably. The "K" winding ratio values, which gradually increase with the gradual increase in the bobbin diameter (bobbin diameter represented by the horizontal axis of FIG. 21), are compared in the electronic comparator of the mini-computer 3 with the whole-number or exact fraction values representing overall those "K" ribbing orders considered dangerous (critical values) for the quality of the winding underway in the formation of the wound yarn bobbin 1. The winding underway operates in a non-critical region and the bobbin 1 gradually grows with wound yarn 12, all as represented on the block diagram of FIG. 22 by the ring positioned to the left, which closes downwards with the deviator block 49.

Figure 5:
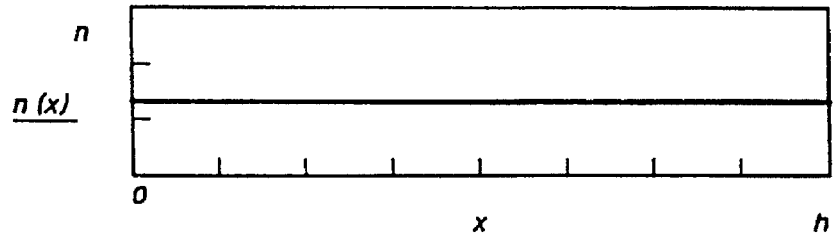

The diameter of the bobbin 1 increases along a portion of the line 47, said line 47 being characterized by a constant crossing (winding) angle. The winding underway is also represented schematically in its geometrical characteristics by FIGS. 2, 3*a*, 3*b*, 4*a*, 4*b* and in its physical quantities by FIGS. 5, 6 and 7.

Figure 6:
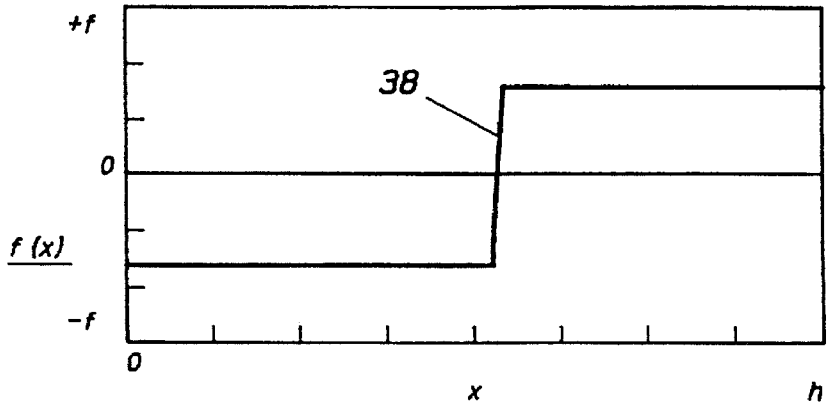

In this respect, the lever linkage 24 and 25 which angularly inclines the bobbin carrier arm is in its normal position, obliging the drag line 38 to assume a central position B (see FIGS. 3*a* and 3*b*), with a substantially constant contact pressure n(x) between the bobbin 1 and the roller 9 and with distribution of the drag force f(x) in accordance with FIG. 6.

Figure 7:
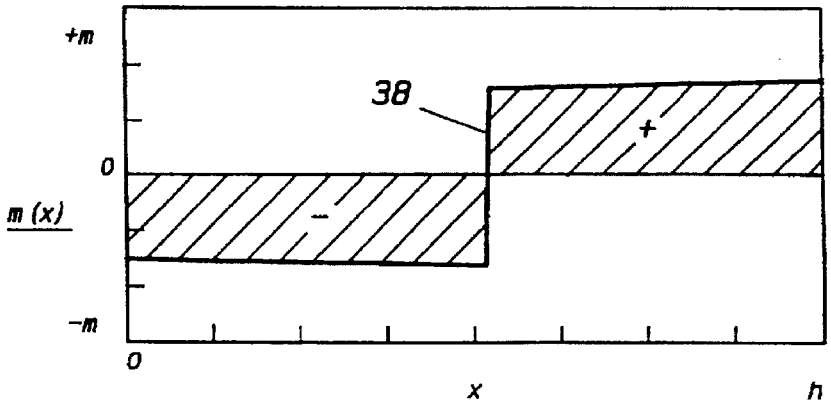

Said drag force f(x) results in a distribution of the drag moment m(x) as shown in FIG. 7, which is easily understandable. The winding ratio "K" varies by increasing with an increasing diameter of the bobbin 1, at a certain moment the control unit 3 sensing that the ratio "K" equals the "K" value corresponding to the lower limit of the band zone straddling the first ribbing line K1. The "K" value corresponding to said lower limit 42 (see FIG. 20) geometrically corresponds to the predetermined minimum distance between two consecutive turns in the winding underway.

At the moment of operation represented graphically by the point 42 the control unit 3 provides at its output electrical signals which via the cable 50 activate the motive source 6 to induce a progression of small angular rotations of the disc 35, to result in a controlled rotation of the bobbin carrier arm 27 via the pin 33 and lever 24.

The line of contact 38 shifts gradually towards the left end of the bobbin to achieve in the limit the geometrical configuration represented by FIGS. 8 and 9.

During said gradual shift towards the left end of the bobbin 1, the rate of angular rotation Wr of the bobbin remains substantially constant during the continuous increase in the wound yarn diameter.

The result of this is a constant winding ratio "K" from the point 42 to the point 44 along the line portion 41. The winding underway along the portion 41 is in the critical region with controlled growth.

Figure 22:
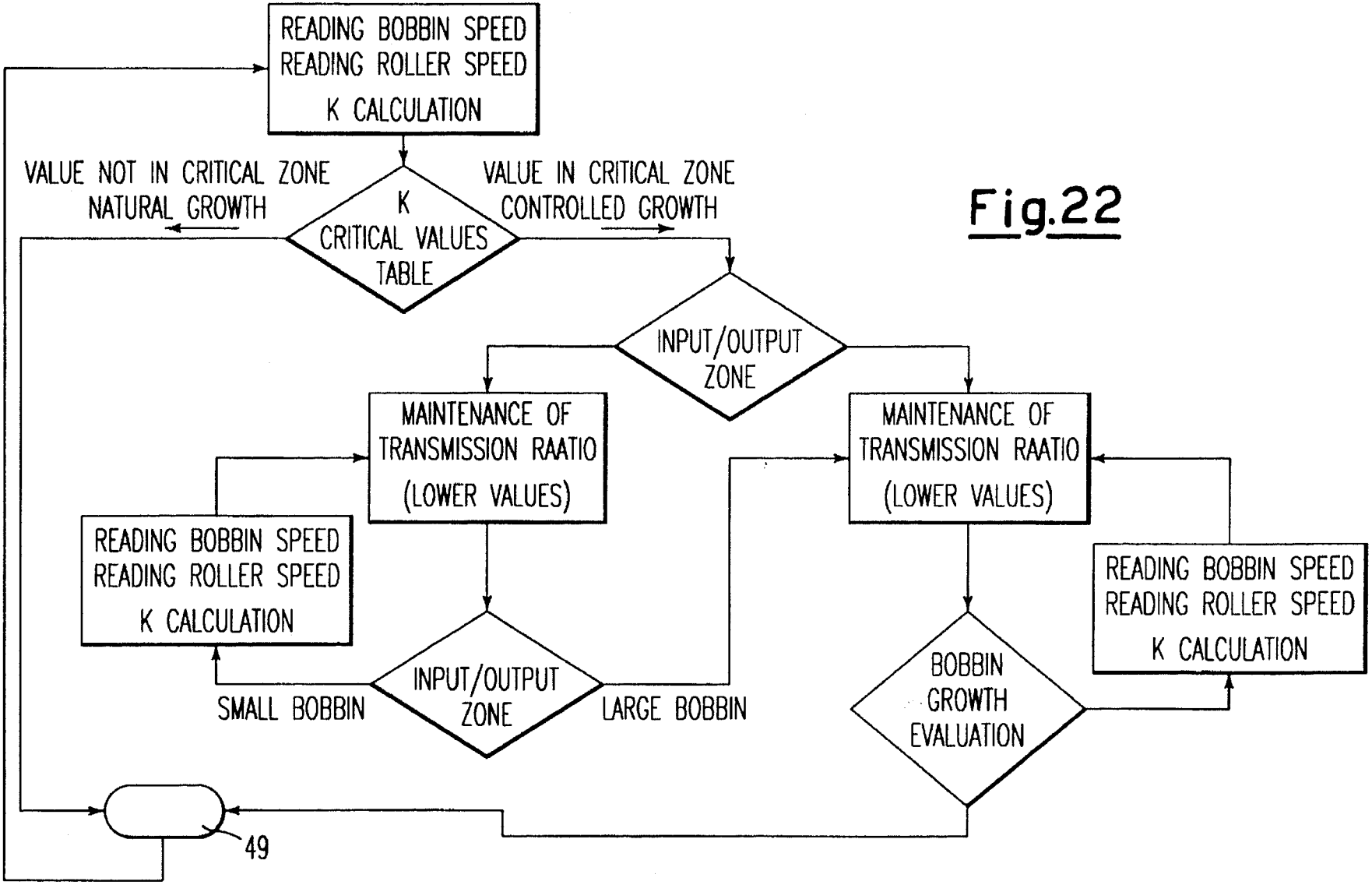
FIG. 22 is a block diagram of the operating system representing the method in accordance with the present invention.

In the block diagram of FIG. 22 said winding with "K" maintained constant is represented by the ring positioned to the left, identified by the term "small bobbin" in the sense that the drag line 38 is gradually shifted towards the left end of the bobbin 1.

This shift action corresponds respectively, according the above mentioned alternative cases, to the shift of the drag line 38 towards the minor diameter of the conical bobbin, or to the shift of the drag line 38 towards the major diameter of the drive grooved cone.

Figure 10A:
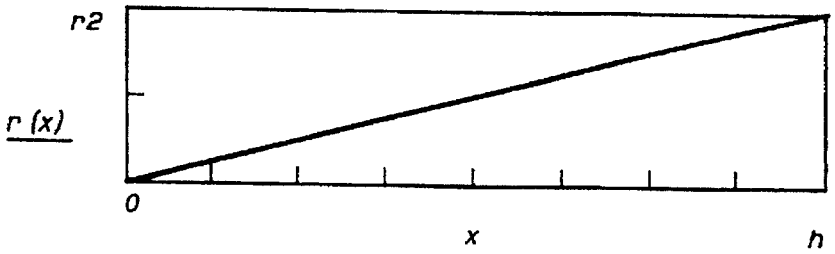
FIGS. 10a, 10b, 11, 12 and 13 show schematically the graphs respectively of the varying bobbin radius, the contact pressure, the drag force distribution and the drag moment distribution when the no-movement line is in a position close to the left end of the bobbin, as shown schematically in FIG. 9.
Figure 10B:
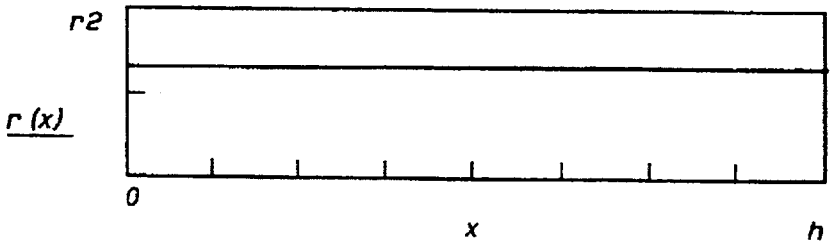
Figure 11:
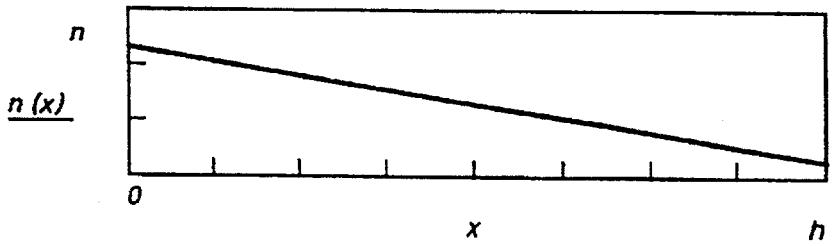
Figure 12:
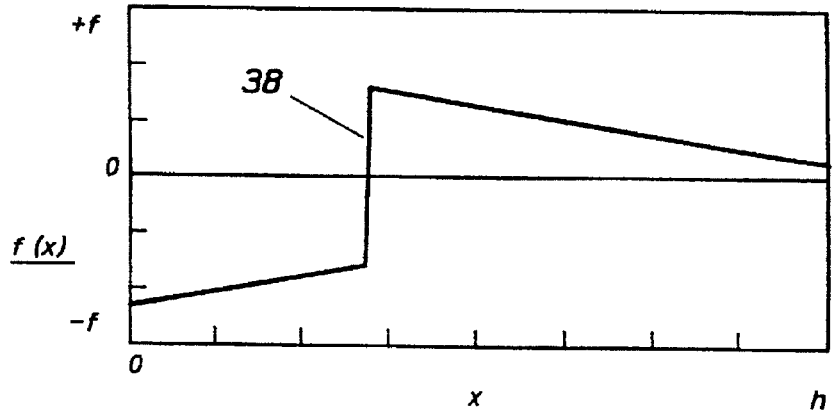
Figure 13:
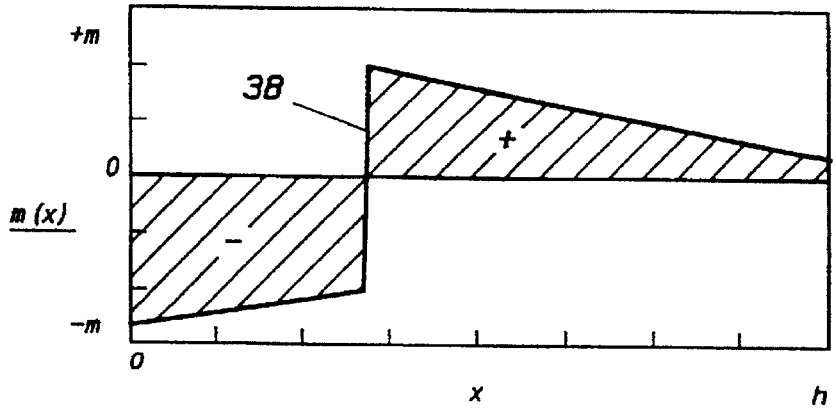

The winding corresponding to the geometrical configuration of FIGS. 8, 9 and 10 is characterized by the variation in contact pressure n(x) shown in FIG. 11, the variation in drag force f(x) shown in FIG. 1 and the variation in drag moment m(x) shown in FIG. 13. Said quantities are the resultant effects along the contact generator between the roller 9 and the overlying bobbin 1.

The controlled-growth winding reaches the point 44.

At that moment of operation represented graphically by said point 44, the control unit 3 provides at its output electrical signals which via the cable 50 activate the motive source 6 to induce instantaneous angular rotations of the disc 35, to achieve the geometrical configuration shown in FIG. 14. Said configuration causes the bobbin carrier arm 27 to incline the bobbin 1 towards the right end, hence shifting the line of contact 38 into the position of FIGS. 15.

Figure 16A:
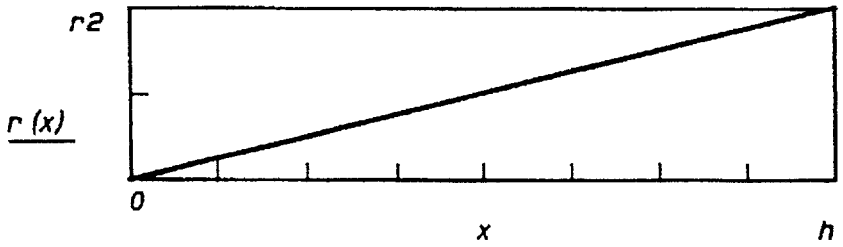
FIGS. 16a, 16b, 17, 18 and 19 show schematically the graphs respectively of the varying conical bobbin radius, the contact pressure, the drag force distribution and the drag moment distribution when the no-movement line is in a position close to the right end of the bobbin, as shown in FIG. 15.
Figure 16B:
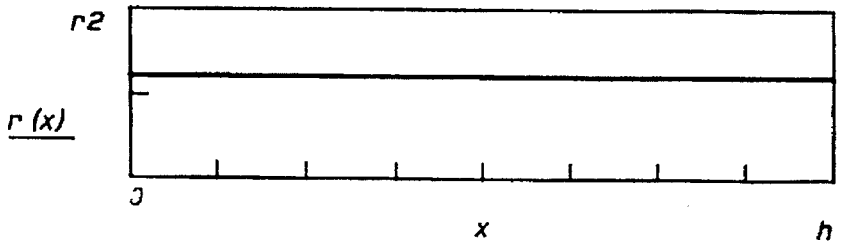
Figure 17:
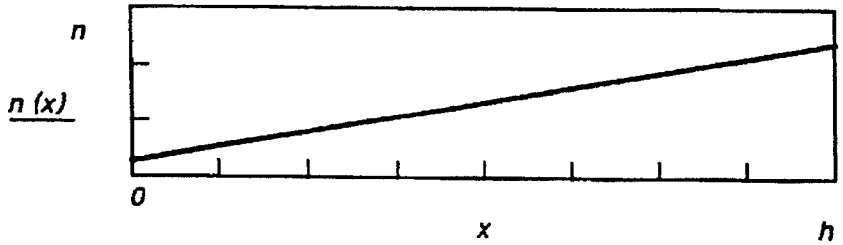
Figure 18:
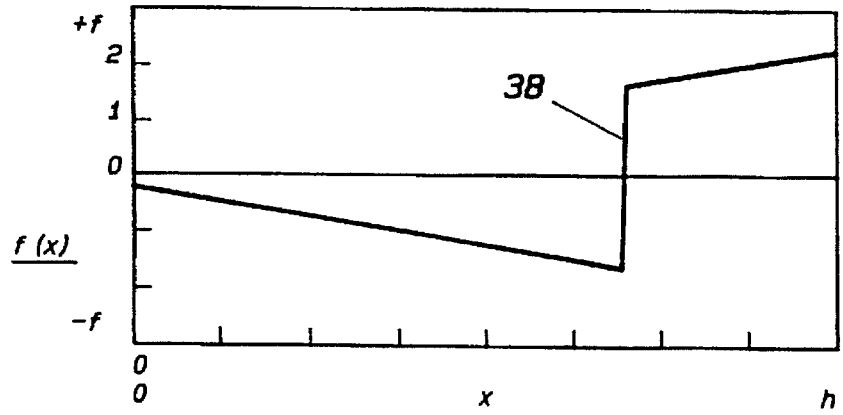
Figure 19:
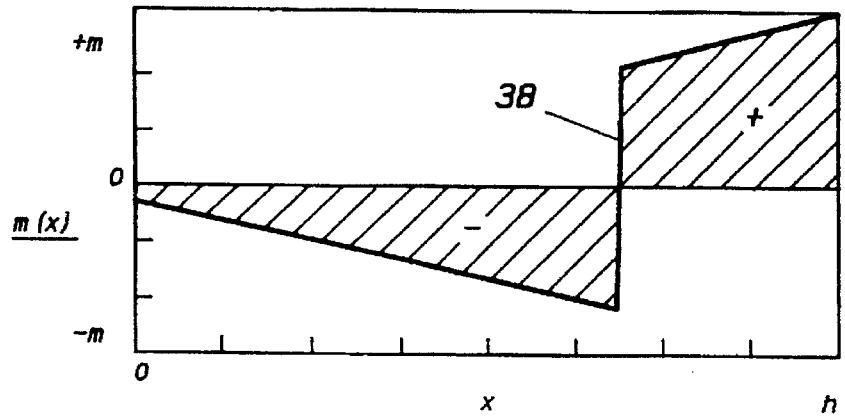

The winding then passes rapidly from the operating point 44 to the operating point 46 along the substantially vertical line portion 43. The winding resulting from the geometrical configuration of FIGS. 14, 15 and 16 is characterized by the variation in the contact pressure n(x) shown in FIG. 17, by the variation in the drag force f(x) shown in FIG. 18 and by the variation in the drag moment m(x) shown in FIG. 19. Said quantities are the resultant effects along the contact generator between the grooved roller 9 and the overlying bobbin 1 when the line of contact 38 is in proximity to the right end of the bobbin 1.

Figure 20:
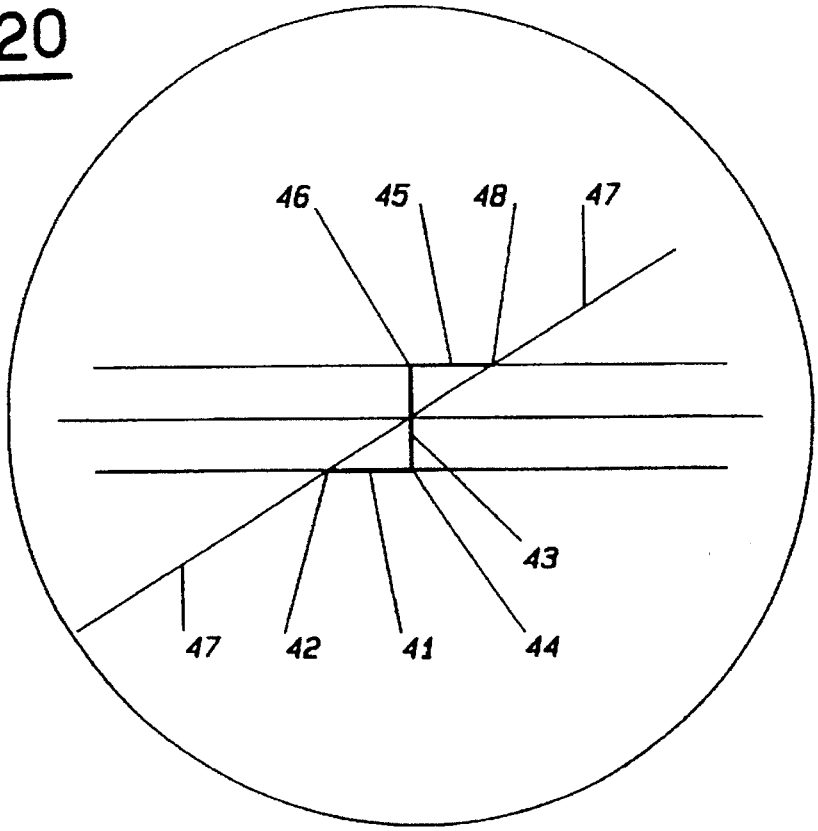
Figure 21:
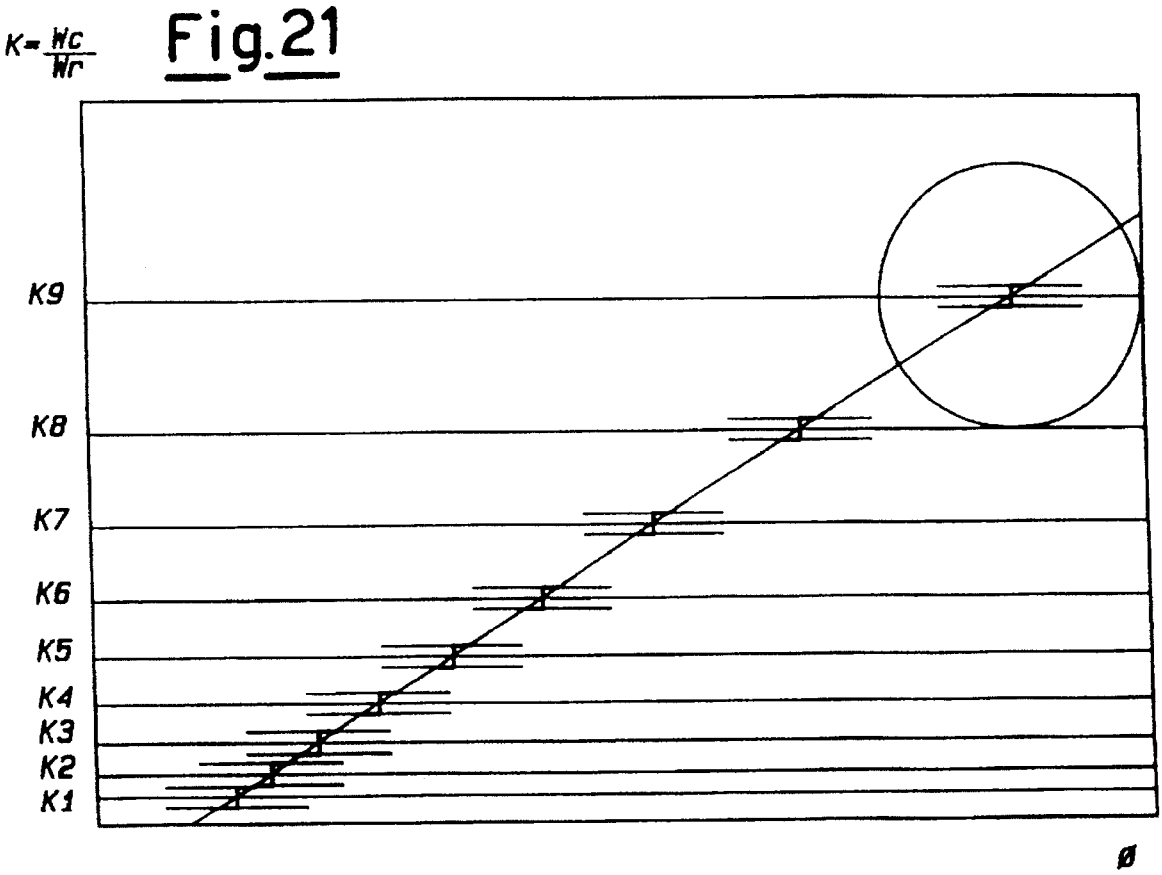
FIG. 21 is a diagram showing lines of whole-number or exact fraction constant winding ratio, and also the operative winding line which when in correspondence with a ribbing line comprises horizontal line portions and a vertical line portion representing the instantaneous change in the winding ratio.

The winding underway deriving from the configuration of FIG. 15 corresponds to the operating point 46 of FIG. 20.

Controlled-growth winding therefore again commences in that the control unit 3 provides at its output electrical signals which via the cable 50 activate the motive source 6 to induce a progression of small angular rotations of the disc 35, to result in a controlled rotation of the bobbin carrier arm 27 via the pin 33 and lever 24. The line of contact shifts gradually towards the center of the bobbin 1 into the position of FIG. 3.

During said gradual shift towards the center of the bobbin 1, the rate of angular rotation Wr of the bobbin remains substantially constant during the continuous increase in the wound yarn diameter. The result of this is a constant winding ratio "K" from the point 46 to the point 48 along the line portion 45. The winding underway along the portion 4 is in the critical region with controlled growth, and is also along the upper limit of the band zone straddling the first ribbing line K1. In the block diagram of FIG. 22, said winding at constant "K" is represented by the ring positioned to the right and identified by the term "large bobbin" in the sense that the drag line 38 is shifted gradually towards the center onto progressively smaller diameters.

Figure 2:
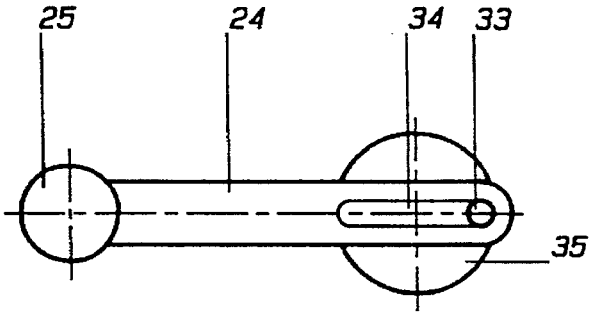
FIG. 2 shows schematically the normal position of the lever linkage for inclining the bobbin.
Figure 4A:
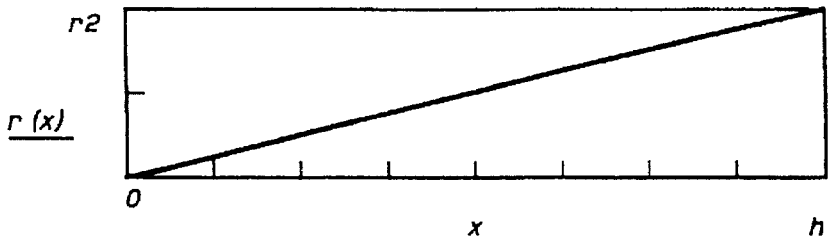
FIGS. 4*a*, 4*b*, 5, 6 and 7 show schematically the graphs respectively of the varying bobbin radius r(x), the substantially uniform contact pressure n(x) along the line on which the bobbin is dragged by the grooved roller, the drag force f(x) which is partly driving and partly braking in that the no-movement line divides the bobbin into two parts, and the drag moment m(x) which is also divided into a "driving moment" and a "braking moment" because of the taper of the coupling between the bobbin and the roller, all as is well known from the state of the art.
Figure 4B:
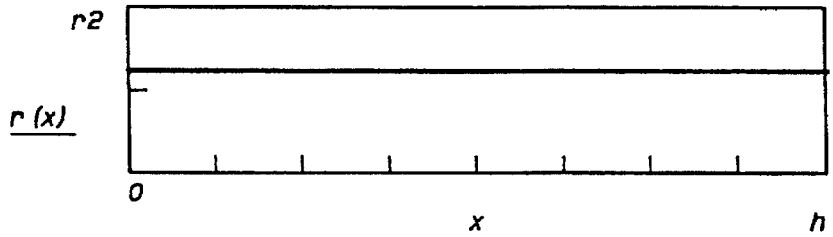

The new operational winding point 48 is followed by winding under increasing "K" along the line 47 in accordance with the geometrical configuration of FIGS. 2 and 3.

At the next ribbing line the control unit 3 operates with a cycle identical to the preceding described cycle, being again repeated identically in proximity with the various ribbing orders considered dangerous for the quality of the winding underway. Using the apparatus of the present invention a method is proposed herein which is able to form wound yarn bobbins with their collected yarn turns perfectly distributed in the sense of being free of ribbing considered damaging for the subsequent processing in the production of a textile article. The description is given only by way of non-limiting example, and modifications are possible without leaving the scope of protection of the invention.

We claim:

1. A method for distributing wound yarn on a forming bobbing driven by a grooved drive roller in a collection station of a winding machine, in which the bobbin and roller have different shapes and are respectively one of cylindrically shaped and conically shaped, which comprises:

distributing yarn on the bobbin by shifting a driving line of contact between the bobbin and the roller towards one of a major and minor diameter of whichever of the bobbin and roller is conically shaped by varying inclination of the bobbin with respect to the drive roller in order to avoid a ribbing effect on the bobbin;

rotating the groove cylindrical roller at a constant rotational speed and rotating the bobbin, which rests under pressure on the grooved cylindrical drive roller so as to cross the yarn by unwinding the yarn from an underlying feed package;

determining moment by moment a deposition distance between two yarn turns successively deposited on the surface of the conical bobbin during formation;

determining on the basis of previously recorded successive variations in distance between two consecutive turns when said distance falls below a predetermined minimum value, and when said distance again rises above said predetermined minimum value;

activating, before the distance between two consecutive yarn turns falls below the predetermined minimum value, a motive source which by a lever linkage progressively inclines the conical bobbin so as to vary the transmission ratio thereof with the grooved cylindrical roller, in order to maintain the distance between consecutive turns at substantially a value greater than the predetermined minimum value and to progressively increase inclination of the bobbin each time the distance between said consecutive turns tends to fall, at least until the deposition of consecutive turns at a distance apart less than the predetermined minimum value ceases;

restoring initial conditions of operation by operating the motive source so as to incline the bobbin in an opposite direction so as to annul the previously induced inclination and cause a change in the transmission ratio, which at a certain moment assumes a value corresponding to deposition of turns at a distance apart less than the predetermined minimum distance apart, and with a rapidity so as to cause only an insignificant quantity of turns to be deposited in proximity with or superposed on each other, and which prevents damage to the quality of the bobbin under formation.

2. A method for distributing wound yarn on a forming bobbing driven by a grooved drive roller in a collection station of a winding machine, in which the bobbin and roller have different shapes and are respectively one of cylindrically shaped and conically shaped, which comprises:

distributing yarn on the bobbin by shifting a driving line of contact between the bobbin and the roller towards one of a major and minor diameter of whichever of the bobbin and roller is conically shaped by varying inclination of the bobbin with respect to the drive roller in order to avoid a ribbing effect on the bobbin;

rotating the grooved cone at a constant rotational speed and rotating the bobbin, which rests under pressure on the grooved drive cone, so as to cross the yarn by unwinding the yarn from an underlying feed package;

determining moment by moment a deposition distance between two yarn turns successively deposited on the surface of the cylindrical bobbin during formation;

determining, on the basis of previously recorded successive variations in distance between two consecutive turns, when said distance falls below a predetermined minimum value, and when said distance again rises above said predetermined minimum value;

activating, before the distance between two consecutive yarn turns falls below the predetermined minimum value, a motive source which by a lever linkage progressively inclines the cylindrical bobbin to vary a transmission ratio thereof with the grooved cone, in order to maintain the distance between consecutive turns at a value greater than the predetermined minimum value and to progressively increase the bobbin inclination each time the distance between said consecutive turns tends to fall, at least until the deposition of consecutive turns at a distance apart less than the predetermined minimum value ceases;

restoring the initial conditions by operating the motive source to incline the cylindrical bobbin in the opposite direction, to annul the previously induced inclination and cause a change in the transmission ratio, which at a certain moment assumes a value corresponding to deposition of turns at a distance apart less than the predetermined minimum distance apart, and with a rapidity such as to cause only an insignificant quantity of turns to be deposited very close to or superposed on each other, and which prevents damage to the quality of the bobbin under formation.

3. An apparatus for distributing wound yarn on a forming bobbin device by a grooved drive roller in a collection station of a winding machine, which comprises: a control unit which includes:

keyboard;

a mini-computer into which values relating to the winding parameters, ribbing orders considered to be damaging with respect to the quality of winding underway and a predetermined minimum distance between two consecutive yarn turns in one complete to-and-fro deposition of the yarn on the surface of the forming bobbin are firstly fed via said keyboard, said mini-computer having a computing center wherein the values are processed and a computerized formation of a group of curves is obtained, each group having a constant winding ratio, the mini-computer then receiving electrical pulses generated upon each revolution, or a submultiple thereof, of the grooved drive roller and a bobbin carrier mandrel of the bobbin by transducer probes applied thereto, so as to provide a continuous instantaneous indication of the rotational values of said drive roller and bobbin carrier mandrel, the latter rotational values being compared with said operational winding parameters within an electronic comparator of the minicomputer, in order to generate a plurality of command signals in continuous succession such that the collection station operates in regions not in proximity to a region undergoing the ribbing effect; and a mechanism rotating the groove cylindrical roller at a constant rotational speed and a mechanism rotating the bobbin which rests under pressure on the groove cylindrical drive roller so as to cross the yarn by unwinding the yarn from an underlying feed package, wherein said computing center:

determines moment by moment a deposition distance between two yarn turns successively deposited on the surface of the conical bobbin during formation;

determines on the basis of previously recorded successive variations in distance between two consecutive turns when said distance falls below a predetermined minimum value, and when said distance again rises above said predetermined minimum value;

activates, before the distance between two consecutive yarn turns falls below the predetermined minimum value, a motive source which by a lever linkage progressively inclines the conical bobbin so as to vary the transmission ratio thereof with the groove cylindrical roller, in order to maintain the distance between consecutive turns at substantially a value greater than the predetermined minimum value and to progressively increase inclination of the bobbin each time the distance between said consecutive turns tends to fall, at least until the deposition of consecutive turns at a distance apart less than the predetermined minimum value ceases; and restores initial conditions of operation by operating the motive source so as to incline the bobbin in an opposite direction and to annul the previously induced inclination and cause a change in the transmission ratio, which at a certain moment assumes a value corresponding to deposition of turns at a distance apart less than the predetermined minimum distance apart, and with a rapidity so as to cause only an insignificant quantity of turns to be deposited in proximity with or superposed on each other, and which prevents damage to the quality of the bobbin under formation.

4. An apparatus for distributing wound yarn on a forming bobbin as claimed in claim 3, which comprises a plurality of yarn winding stations, each of said stations including the apparatus for distributing wound yarn.

5. A collection station equipped with an apparatus as claimed in one of claims 3 or 4 which enables yarn to be wound by distributing it on the forming bobbin such that the bobbin is free from damaging ribbing.

* * * * *